US005263867A

United States Patent [19]

Doi et al.

[11] Patent Number: 5,263,867

[45] Date of Patent: Nov. 23, 1993

[54] CONNECTOR WITH CONTACT LOCATING HOUSING PART

[75] Inventors: Etsuro Doi, Saitama; Kiyoshi Atoh; Mutsuo Hatanaka, both of Tokyo, all of Japan

[73] Assignee: Kel Corporation, Tokyo, Japan

[21] Appl. No.: 785,349

[22] Filed: Nov. 4, 1991

Related U.S. Application Data

[63] Continuation-in-part of Ser. No. 670,793, Mar. 18, 1991.

[30] Foreign Application Priority Data

Mar. 28, 1991 [JP] Japan ..... 3-91749

[51] Int. Cl.[5] ..... H01R 9/09

[52] U.S. Cl. ..... 439/62; 439/79; 439/81; 439/636; 439/752

[58] Field of Search ..... 439/62, 76, 79-81, 439/83, 247, 248, 567, 629, 630, 634, 636, 637, 712, 752, 876

[56] References Cited

U.S. PATENT DOCUMENTS 4,611,880 9/1986 Petersen et al. ..... 439/752
4,639,056 1/1987 Lindeman et al. ..... 439/79

FOREIGN PATENT DOCUMENTS 8704015 7/1987 World Int. Prop. O. ..... 439/62

*Primary Examiner*—Paula A. Bradley
*Attorney, Agent, or Firm*—Robert W. J. Usher

[57] ABSTRACT

A surface mount connector comprises two assemblable housing parts for engagement with a circuit board and for mating with a complementary connector respectively. A series of contacts are anchored in the board engaging part and the other mating part is provided with contact locating surface portions which engage and press the contacts into a coplanar circuit board engaging position when the two housing parts are assembled together.

10 Claims, 7 Drawing Sheets

CONNECTOR WITH CONTACT LOCATING HOUSING PART

This is a continuation-in-part application of application Ser. No. 670,793, filed Mar. 18, 1991.

FIELD OF THE INVENTION

The invention relates to an electrical connector, particularly to a surface mount connector with a contact locating housing part.

BACKGROUND OF THE INVENTION

As shown schematically in FIG. 10, a typical, known surface mount connector 1 comprises a one-piece, insulating, receptacle-form housing 2 retaining a longitudinally extending row of pairs of opposed metal contacts 3 mounted on a circuit board 4.

The housing has a base wall 5 and feet or "stand offs" 6 depending from opposite longitudinal ends thereof which maintain the base wall 5 spaced above the upper surface of the circuit board. Each contact has an upstanding connecting portion 7 for connection to corresponding contacts of a mating connector and joined by a medial portion, anchored in the base by molding-in (as an insert), to a leg portion 8 which bends out under the base to extend laterally outwardly for connection by reflow soldering to conductive pads 9 of the circuit board.

However, the connector of the prior art is susceptible to several problems, and disadvantage. For example, when the contacts 3 are installed in the housing 2, the legs 8 are sometimes not coplanar with some being deformed upwardly, for example, possibly even out of the circuit board engaging plane, with the result that the legs 8 cannot be soldered to the pads of the circuit board 4 so they make contact with them equally, resulting in an unreliable connection.

Furthermore, as the legs 8 of the contacts 3 curve as they extend outwardly from the base 5 of the housing 2, the space or gap between a transversely opposed pair of contacts is relatively small so that an unwanted solder bridge is relatively easily produced between the legs 8 during soldering thereof to the pads 9.

In addition, since much of the legs 8 and their adjacent parts are located beneath the base 5, it is difficult visually to inspect the soldering to the pads to ascertain the quality thereof.

Furthermore, since the gap H between the lower surface of the base 5 and the circuit board 4 is narrow and the radius of curvature of the legs 8 is relatively small, the solder fillet formed in the curved part of the leg 8 is relatively small, resulting in undesirably low soldering strength.

SUMMARY OF THE INVENTION

One object of the invention is to provide a surface mount electrical connector the assembly of which, ensures that the contacts all are located below or within the circuit board engaging plane.

A further object of the invention is to provide a surface mount connector having a bipartite housing with contacts being anchored in one part and the other part having contact locating portions, such that assembly of the two housing parts brings the contact locating portions into engagement with the contacts which, if deformed, are pressed thereby into a common plane for accurate engagement with the pads of the circuit board.

According to the invention, there is provided a surface mount connector having a bipartite insulating housing comprising an elongate base part for mounting adjacent a face of a circuit board and a mating part having a receptacle wall portion for assembly with the base part to upstand therefrom for mating engagement with a complementary connector, a series of elongate metal contacts having contact arm portions and board connecting leg portions extending to respective opposite ends thereof and joined together by medial portions anchored in the base part in longitudinally spaced apart relation so that the contacts extend transversely of the base part in a longitudinally extending row with the arm portions upstanding from an upper face of the base part and the board connecting leg portions extending laterally outwardly beyond a longitudinal edge of the base part, the mating housing part having contact leg engaging surfaces and being assemblable on the base part with the contact mating arm portions received within the receptacle walls and the contact leg engaging surfaces in locating engagement with upper surfaces of respective leg portions thereby maintaining free ends thereof within a circuit board engaging plane.

BRIEF DESCRIPTION OF THE DRAWINGS

Specific embodiments of the invention will now be described by way of example only and with reference to the accompanying drawings in which:

As shown in FIGS. 1–6, the connector 10 comprises a bipartite insulating housing 11 in which are mounted a series of metal contacts 12.

The housing comprises an elongate base **11*a* and a receptacle-form mating part 11*b* defined by elongate sidewalls 16** upstanding from the base.

Figure 1:
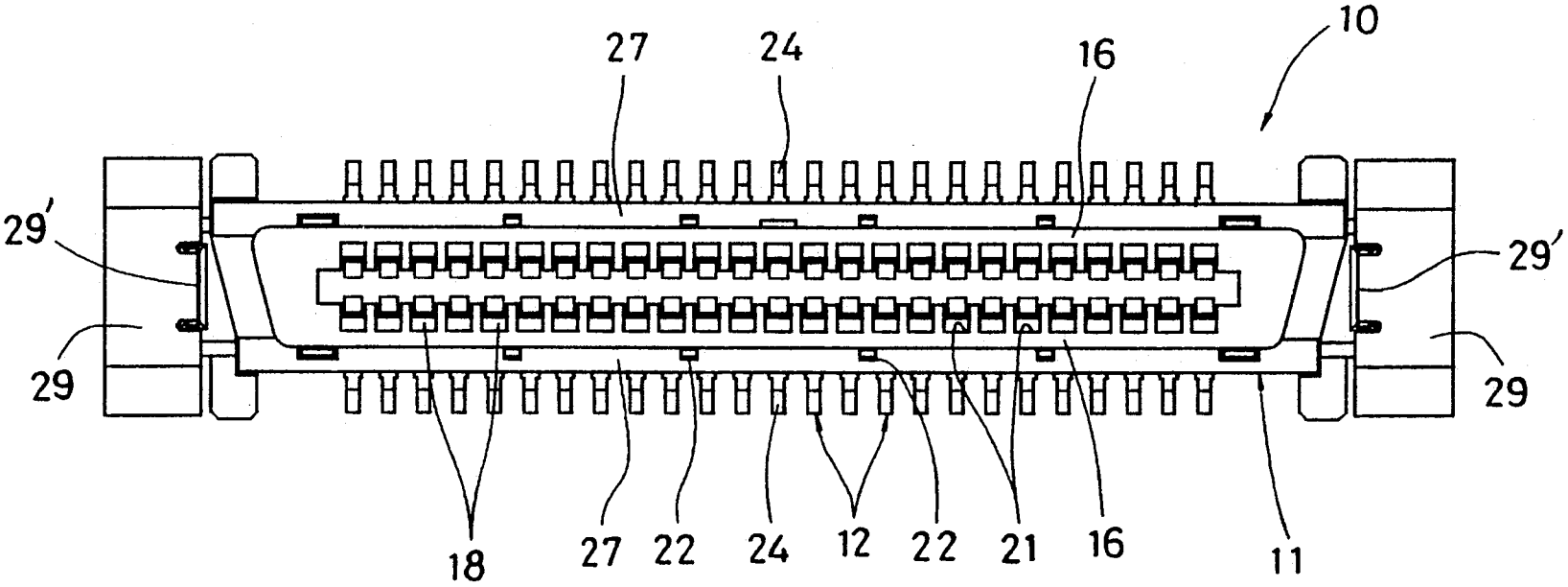
FIG. 1 is a plan view of a first example of surface mount electrical connector according to the invention.
Figure 2:
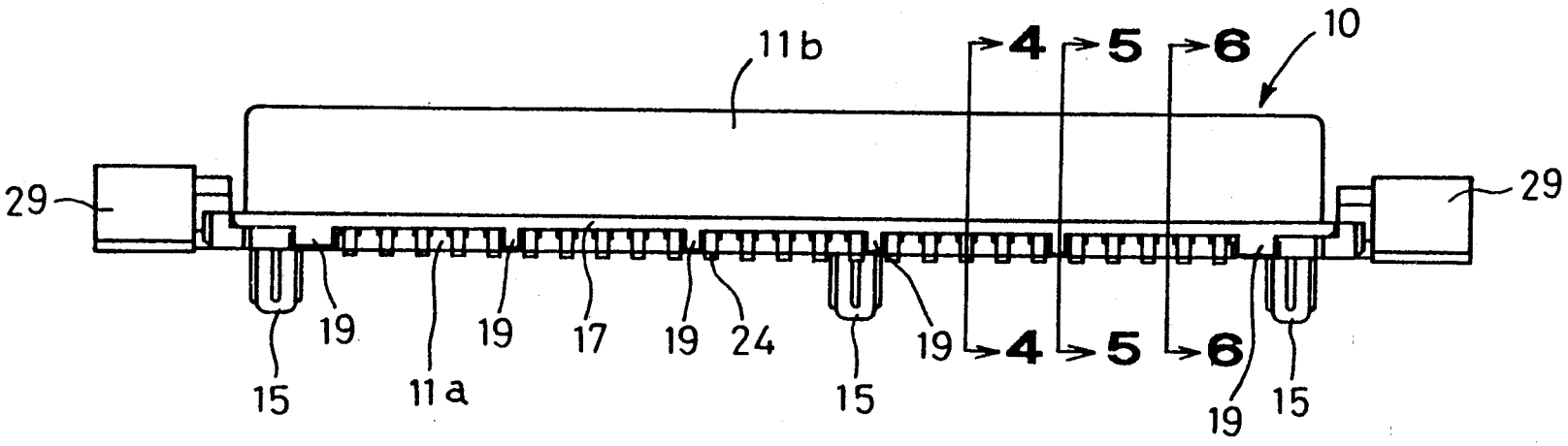
FIG. 2 is a side elevation of the connector shown in FIG. 1.
Figure 3:
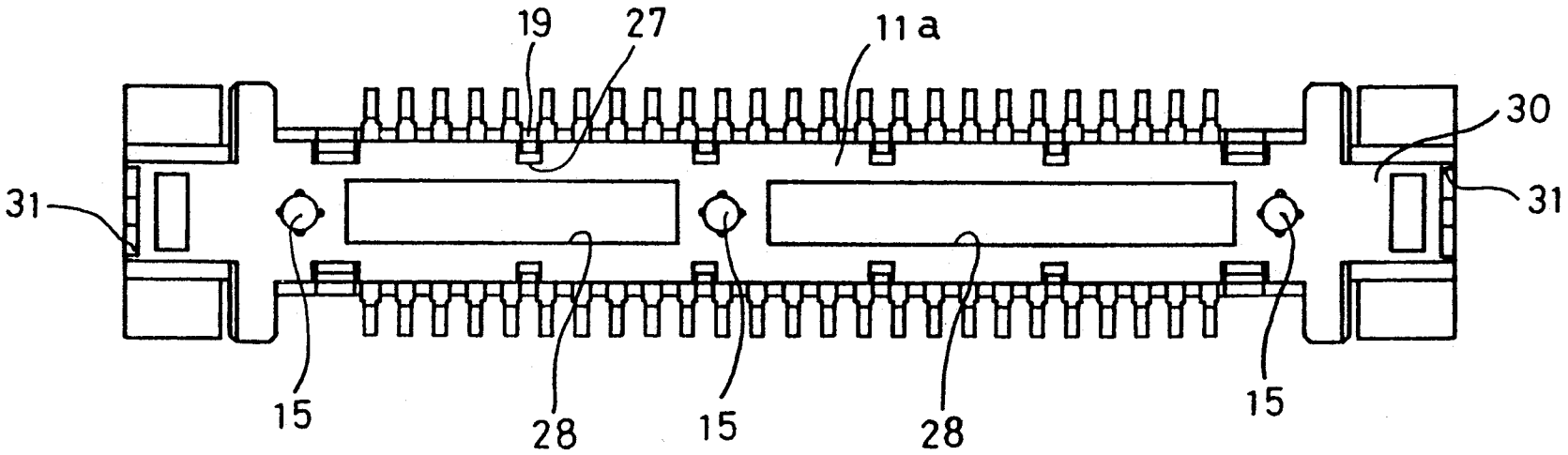
FIG. 3 is an underplan of the electrical connector shown in FIG. 1.
Figure 4:
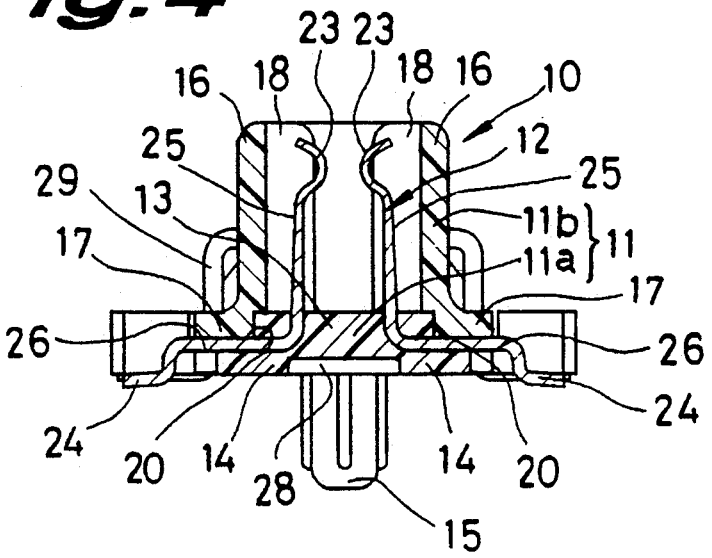
FIG. 4 is a cross-sectional view taken along line 4—4 of FIG. 2.
Figure 5:
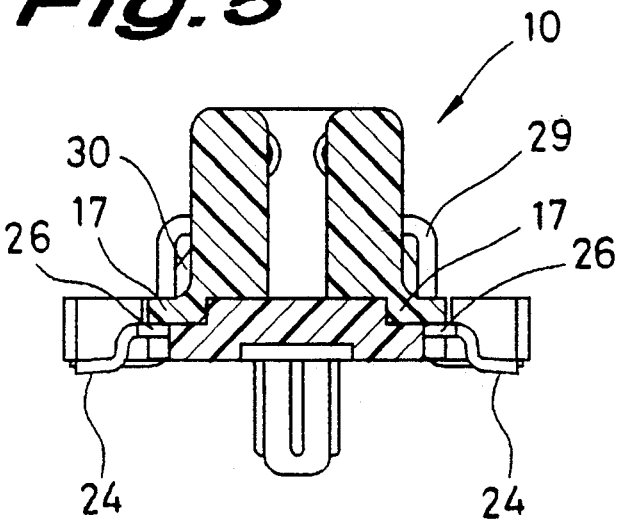
FIG. 5 is a cross-sectional view taken along line 5—5 of FIG. 2.
Figure 6:
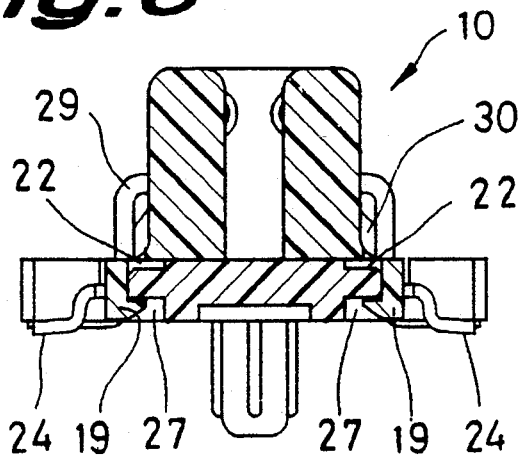
FIG. 6 is a cross-sectional view taken along line 6—6 of FIG. 2.

The base **11*a* is stepped along respective opposite longitudinal edges thereof providing a central upper level 13 and lower levels 14 extending lengthwise along both sides thereof. As shown in FIG. 6, the lower level step is formed with raised portions at longitudinally spaced apart integrals to define latching abutments over latch receiving cavities 27 formed in the underside thereof. Circuit board mounting projections 15 depend at intervals from the under-surface of the base 11*a* at locations along the center line thereof for anchoring engagement in through-apertures in a circuit board (not shown). The side walls 16 are formed along opposite sides of lower ends thereof with longitudinally extending, laterally outwardly protruding, contact locating edge portions 17 which curve away, substantially perpendicularly, laterally outwardly. Internal cavities or recesses 20 are formed along intersections of the side walls 16 and edge portions 17. A series of pairs of laterally opposed partition walls 18 are formed at intervals along the inner surface of walls 16 and extend laterally inwardly towards each other defining between them contact receiving cavities 21. Pairs of hook-form latches depend from the outer extremities of the lower surfaces of the edge portion 17 at spaced apart locations, the latches of each pair being in lateral alignment with a pair of partition walls. As shown in FIG. 6, apertures 22 are formed to extend through the protruding edge portion 17 at locations between the depending parts of the latches 19** and the bases of the aligned partitioned walls for accommodating the raised portions of the steps defining the latching abutments in the base.

The contacts 12 are stamped and formed metal parts, having contact portions 23 and board connecting tips or feet 24 on opposite free ends extending upwardly and laterally outwardly from arm and leg portions 25 and 26, respectively, which extend perpendicularly to each other from a bent, medial anchoring portion. Portions of the legs 26 are also bent downwardly as they join the board connecting feet, which extend laterally outwardly and incline downwardly at an angle therefrom. The contacts 12 are located in the base part in two rows and at a predetermined pitch by in-molding the anchoring portion in the base material so that the legs 26 extend outwardly of the opposite side edges or faces of the step in respective channels with upper surfaces of the legs coplanar or flush with the channel mouths.

In assembling the mating part **11*b* with the base 11*a*, the mating part 11*b* is aligned with the base so that the upright arms 25 of the contacts 12 are received in the respective cavities 21 in the side walls 16, and the recesses 20 of the side walls 11*b* receive the longitudinally extending side edges of the upper level of the base 11*a* in nesting engagement; the laterally protruding contact locating edge portions 17 of the side walls 16 engage and push the legs downwardly and the hook-form latches 19 are received between adjacent contacts 12 snapping into cavities 27 formed under the latching abutments of the lower level steps at the lower face of the base 11*a*. The under surfaces of the board engaging tips 24 of the contacts 12 are then located slightly below the under-surface of the base 11*a***.

When the mounting projections 15 are inserted into respective apertures in a circuit board, the tips 24 of the contacts are positioned on respective solder pads on the surface of the circuit board for electrical connection thereto by reflow soldering.

An auxiliary implement 29 for fixing the connector 10 to the printed circuit board comprises a metal sheet bent into a channel shaped structure with soldering flanges extending laterally outwardly from free edges of the channel walls and transverse tongues 29' extending upwardly from opposite ends of the channel base wall. The implement is secured to flanged portions 30 extending from opposite longitudinal ends of the housing by one tongue being press fitted in a transverse slot or recess in the flanged portions adjacent the side walls and the other received in slots or recesses 31 formed in the outer ends of the flanged portion.

Figure 7:
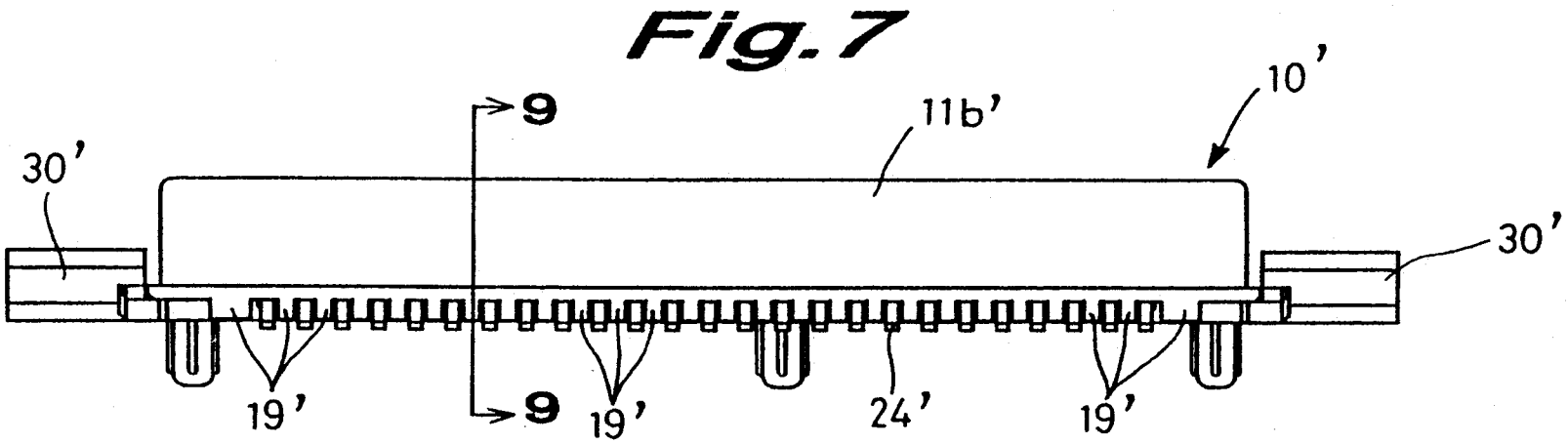
FIG. 7 is an elevation view of a second embodiment of electrical connector according to the invention.
Figure 8:
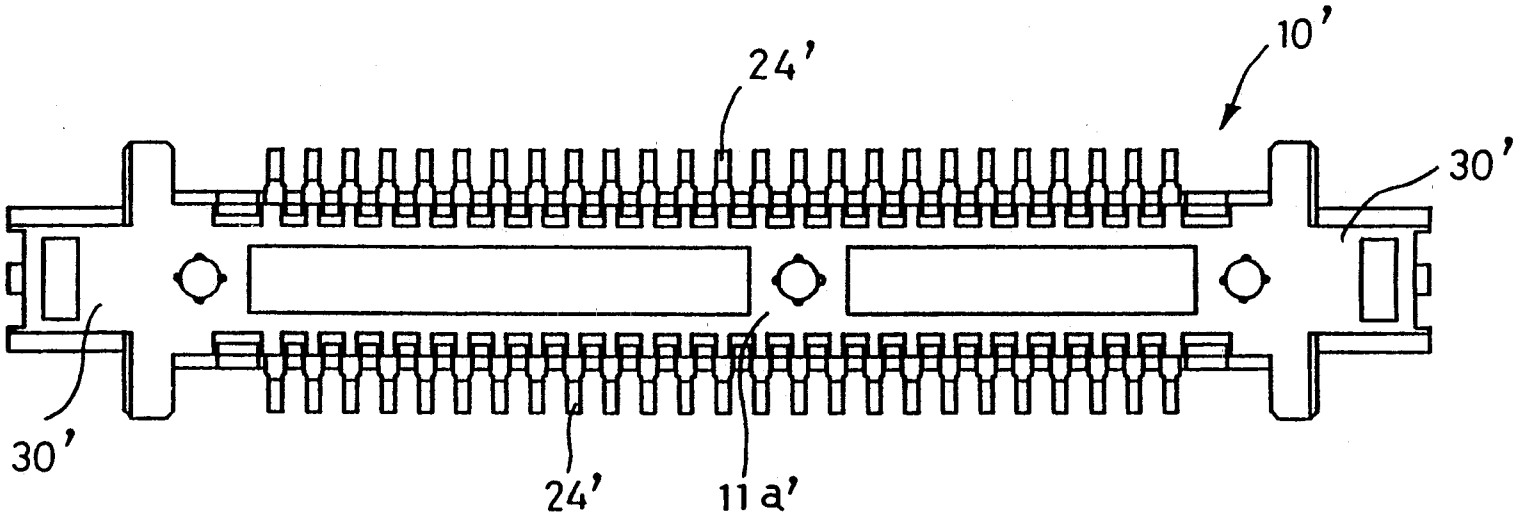
FIG. 8 is an underplan view of the electrical connector shown in FIG. 7.
Figure 9:
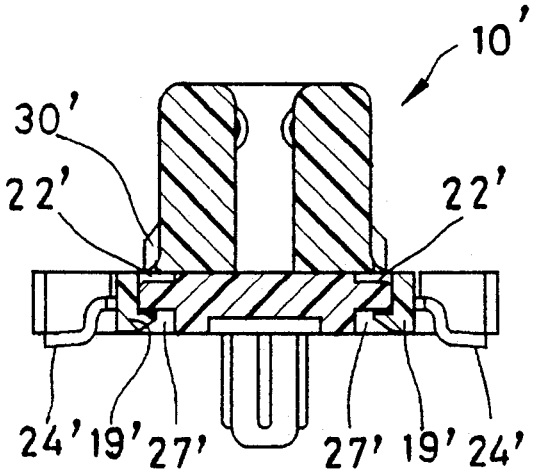
FIG. 9 is a cross-sectional view taken along line 9—9 of FIG. 7; and, FIG. 10 is a cross-sectional view of a typical surface mount connector according to the prior art.
Figure 10:
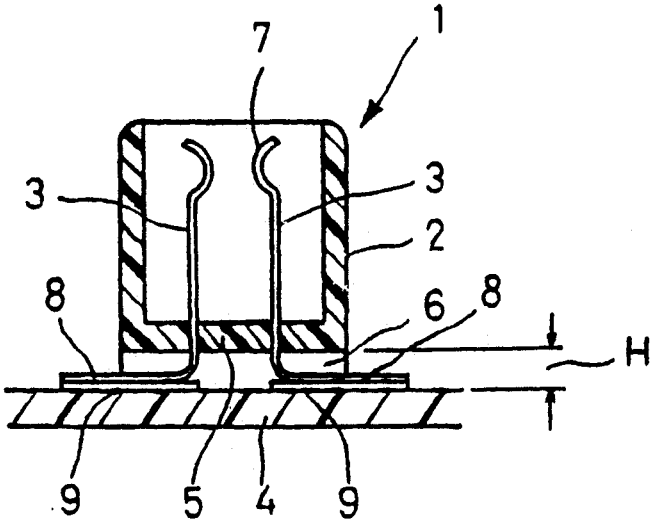
Fig. 10 PRIOR ART

In the second example of connector 10' shown in FIGS. 7–9, the housing and contacts having a similar structure to those of the previous example except that the side walls **11*b*' are formed with hook-formed latches 19' extending between the legs 26' of all the contacts 12'. It will be understood, however, that in some cases, where the presence of so many latches would require too great an assembly force, most latches are replaced by simple projections or fingers depending between legs of adjacent contacts 27**.

In the drawings, 28 is a concave part formed in the under surface of the base **11*a***.

Thus, with the connector of the invention, even if some of the contact leg portions are deformed upwardly out of a board engaging plane, the contact locating portions of the side walls press those deformed legs back into the board engaging plane when the side walls are mounted on the base, bringing all the leg portions back within the board engaging plane usually into coplanar relation.

Furthermore, the engagement of the contact locating edge portions with the upper surfaces of all the leg portions assists in preventing leg deformation during assembly handling and mounting of the connector of the circuit board.

The presence of the latch members between the adjacent contacts also prevents deformation thereof in the longitudinal direction.

In addition, since the contact leg portions protrude laterally outwardly beyond respective sides of the connector, it is much easier officially to inspect and maintain the soldering of the feet 24 to the pads of the circuit board than with the conventional connector described above. Furthermore, the possibility of the separation of the connecting feet increasing is obviated a is the production of solder bridges.

Moreover, with the construction of the invention, the leg portions can be made to project from the longitudinal sides of the housing at a high position relative to the surface of a circuit board with the result that the radius of curvature of the leg portions at their junction with the tips 24 can be increased thereby to enable larger and stronger solder fillets to be formed, increasing the overall soldering strength.

As a result, the connector of the invention provides a very reliable connection to the pads of a circuit board.

We claim:

1. A surface mount connector having a bipartite insulating housing comprising an elongate base part for mounting adjacent a face of a circuit board and a mating part having a receptacle wall portion for assembly with the base part to upstand therefrom for mating engagement with a complementary connector, a series of elongate metal contacts having contact arm portions and board connecting leg portions extending to respective opposite ends thereof and joined together by medial portions anchored in the base part independently of the mating part in longitudinally spaced apart relation so that the contacts extend transversely of the base part in a longitudinally extending row with the arm portions upstanding from an upper face of the base part and the board connecting leg portions extending laterally outwardly beyond a longitudinal edge of the base part, the mating housing part having contact leg engaging surfaces and being assemblable on the base part with the contact mating arm portions received within the receptacle walls and the contact leg engaging surfaces in locating engagement with upper surfaces of respective leg portions thereby maintaining free ends thereof within a circuit board engaging plane.

2. A surface mount connector according to claim 1 in which the medial portions of the contacts are anchored in the housing by molding-in.

3. A surface mount connector according to claim 2 in which the base part is formed with a row of transversely extending channels at a corresponding pitch to the contacts, each channel opening to the longitudinal edge of the base part, portions of the contact leg portions adjacent the medial portions being received in respective channels.

4. A surface mount connector according to claim 2 in which the base part is formed with a step extending along said longitudinal edge, the step having upper and lower levels, the arm portions of the contacts being upstanding from the upper level.

5. A surface mount connector according to claim 4 in which the lower level of the step is formed with a row of transversely extending channels at a corresponding pitch to the contacts, each channel opening to the longitudinal edge of the base part, portions of the contact leg portions adjacent the medial portions being received in respective channels.

6. A surface mount connector according to claim 2 in which the contact engaging surfaces are formed on lower portions of mating housing part, which lower portions extend laterally outwardly from lower ends of the wall portions.

7. A surface mount connector according to claim 6 in which the base part is formed with a row of transversely extending channels at a corresponding pitch to the contacts, each channel opening to the longitudinal edge of the base part, portions of the contact leg portions adjacent the medial portions being received in respective channels.

8. A surface mount connector according to claim 6 in which the contact engaging surfaces protrude laterally outwardly beyond the longitudinal edge of the housing base part.

9. A surface mount connector according to claim 8 in which hook-form latches depend at spaced-apart intervals from the laterally outwardly extending surface between at least some adjacent contact leg portions into latching engagement with the longitudinal edge of the base part thereby to mount the mating part on the base part.

10. A surface mount connector having a bipartite insulating housing comprising an elongate base part for mounting adjacent a face of a circuit board and a mating part having a receptacle wall portion for assembly with the base part to upstand therefrom for mating engagement with a complementary connector, a series of elongate metal contacts having contact arm portions and board connecting leg portions extending to respective opposite ends thereof and joined together by medial portions molded in the base part in longitudinally spaced apart relation so that the contacts extend transversely of the base part in a longitudinally extending row, the base part being formed with a step extending along said longitudinal edge providing upper and lower levels and a row of transversely extending channels being formed in the lower level, the contact arm portions upstanding from the upper level and the contact leg portions being received in respective channels and extending laterally outwardly beyond a longitudinal edge of the lower level; portions of the mating housing part extending laterally outwardly from lower ends of the wall portions beyond the longitudinal edge of the lower level and being formed with contact leg engaging surfaces, hook-form latches depending at spaced apart intervals from the laterally outwardly extending portion between at least some adjacent contact leg portions into latching engagement with the longitudinal edge of the base part thereby to secure the mating part assembled with the base part with the contact mating arm portions received within the receptacle walls and the contact leg engaging surfaces in locating engagement with upper surfaces of respective leg portions thereby to maintain free ends thereof within a circuit board engaging plane.

* * * * *